US005264096A

United States Patent [19]

Jorgens

[11] Patent Number: 5,264,096

[45] Date of Patent: Nov. 23, 1993

[54] PROCESS FOR ANODIC OR CATHODIC ELECTROCOATING OF STRIP OR PROFILE MATERIAL

[76] Inventor: Klaus Jorgens, Am Flothen 98, D-5600 Wuppertal, Fed. Rep. of Germany

[21] Appl. No.: 888,048

[22] Filed: May 22, 1992

[30] Foreign Application Priority Data

May 22, 1991 [DE] Fed. Rep. of Germany ..... 4116643

[51] Int. Cl.[5] ..... C25D 13/16

[52] U.S. Cl. ..... 204/180.2; 204/181.6; 204/181.7; 204/300 EC

[58] Field of Search ..... 204/300 EC, 180.2, 181.6, 204/181.7

[56] References Cited

U.S. PATENT DOCUMENTS 3,962.060 6/1976 Brasko et al. ..... 204/180.2
3,997,418 12/1976 Buse et al. ..... 204/180.2

FOREIGN PATENT DOCUMENTS 2548414 10/1977 Fed. Rep. of Germany .
3233517 9/1982 Fed. Rep. of Germany .

*Primary Examiner*—John Niebling
*Assistant Examiner*—Kishor Mayekar
*Attorney, Agent, or Firm*—Ostrolenk, Faber, Gerb & Soffen

[57] ABSTRACT

Process for anodic or cathodic electrocoating of strip or profile material in which electrical contact is made with the strip or profile material, in which an electrically conductive connection is made from at least one surface of the strip or profile material to a cathode or anode by means of a continuous stream or curtain of liquid issuing from the cathode or anode and comprising a walter-soluble paint as the electrolytic liquid, in which the strip or profile material is conveyed for continuous application of the electrolytic liquid to at least one surface, in which the paint particles which form a film on at least one surface are transported with the electrolytic liquid and in which the paint particles which form a film on at least one surface of the strip or profile material are coagulated by applying a direct current voltage between the cathode and the anode.

20 Claims, 1 Drawing Sheet

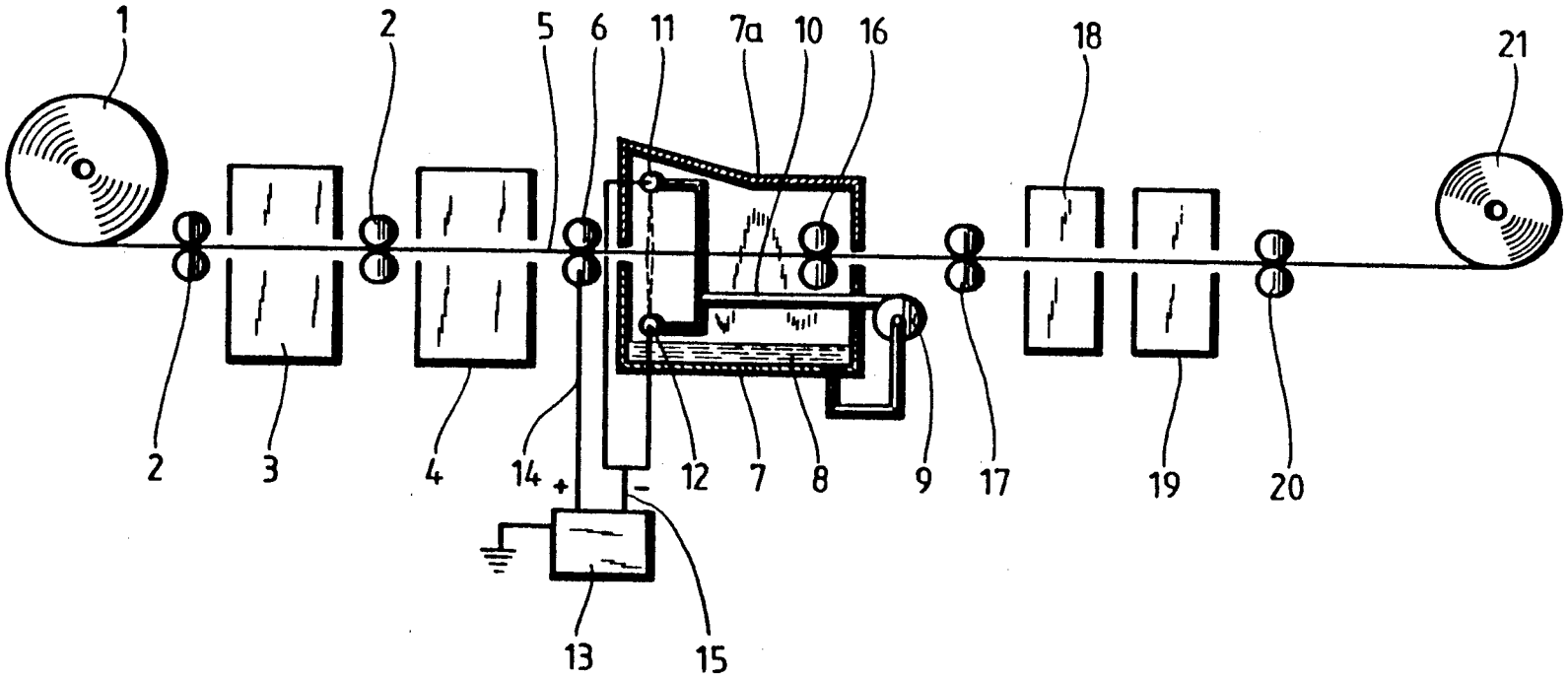
1
2
3
2
4
5
6
11
7a
10
16
17
18
19
20
21
9
8
7
12
15
13
14 +
-

PROCESS FOR ANODIC OR CATHODIC ELECTROCOATING OF STRIP OR PROFILE MATERIAL

BACKGROUND OF THE INVENTION

1. Field of the Invention

The invention pertains to a process for anodic or cathodic electrocoating of strip or profile material.

2. Description of Related Art

A similar process is described with reference to electrocoating of strip material in U.S. Pat. Nos. 4,007,102 and 4,175,018.

The strip material is unwound from a coil, runs over guide rollers through a series of cleaning and rinsing tanks and is then conveyed over additional guide rollers into a tank in which the electrocoating takes place. Electrocoating using a water-soluble paint as the electrolytic liquid is based on the physical principle of electrophoresis. The electrically conductive strip material, aluminum or steel strip, for instance, is directed through the electrocoating bath, whereby the paint is deposited on the metallic substrate during dip-coating by means of electrochemical and chemical reactions. The water-soluble paint functioning as the electrolytic liquid contains as a binder groups which can be ionized and form salts, these being in fact insoluble in water in this form, but which, if these binders contain groups which are acidic in character (carboxyl groups), can be made water soluble in a neutralization reaction using alkaline media, such as amines, whereby salts are formed.

In order to avoid solid particles settling out, the baths must be continuously recirculated; the particles amenable to deposition are in addition transported in this way.

When a DC voltage is applied the phenomenon known as electrophoresis, i.e. the migration of charged particles to the anode or to the cathode, is invoked. If the paint particles in an aqueous system carry a positive charge, i.e. if the binders contain alkaline groups and have been neutralized with acids, they coagulate in the alkaline environment while forming a film on the cathode. The strip material to be painted represents the cathode in this case and one refers to cathodic electro-dip coating. In contrast, the paint particles will coagulate and form a film on the anode if they have been neutralized with amines and exhibit a negative charge in the aqueous system. In this case the workpiece represents the anode and one refers to anodic electro-dip coating.

Using the continuous process described in the above-mentioned U.S. patents makes it possible to coat strip material at high speed and great uniformity. Once the strip has left the electrolyte bath any excess electrolyte which has not coagulated is rinsed off in a subsequent bath, whereafter the coating is dried in a dryer unit.

With the known process incorporating continuous passage through a submersion bath it is only possible to coat both surfaces of the material simultaneously and with layers of identical thicknesses. Furthermore with this process allows only for coating flat strip material, not profiled strip.

SUMMARY OF THE INVENTION

The object of the invention is to create a process for anodic or cathodic electrocoating with which strip or profiled material can be coated in a single pass, on either one or both sides as desired, with the same paint or different paints, at identical or differing thicknesses.

Based on this objective it is proposed by way of invention that in a process of the type mentioned at the outset electrical contact be made with the strip or profile material in order to form an anode or cathode. Furthermore, an electrically conductive connection is made from a cathode or an anode to at least one surface of the strip or profile material by means of a continuous stream or curtain of liquid issuing from the cathode or anode and using water-soluble paint as the electrolytic liquid. The strip or profile material is moved for continuous application of the electrolytic liquid to at least one surface and for coagulation of the paint particles while forming a film on at least one surface of the strip or profile material by applying a direct current voltage between the cathode and the anode.

Due to the fact that the strip or profile material forming the anode or cathode is joined electrically with the other anode or cathode by means of the continuous stream or curtain of electrolytic liquid, the strip or profile material need not be deflected and submerged in a bath for wetting but rather can be moved straight through the system in either a horizontal or vertical direction. Since no bending is required, profiled material which is intrinsically stiff can be electrocoated in a continuous process, whereas coating was previously possible only by dipping individual items in an electrolyte bath.

In order to achieve uniform coating of at least one surface of the strip or profile material the stream or curtain of liquid can form a continuous layer extending across the entire width of the strip or profile material.

A continuous stream or curtain of liquid can be directed simultaneously at both surfaces of the strip or profile material so that both surfaces will be coated at the same time. It is, however, also possible to direct, one after the other, continuous streams or curtains of liquid at either surface of the strip or profile material so that the electrolytic liquids directed at the two surfaces may be of different compositions and in particular of different colors.

Adjusting the cross section of the stream, the velocity of the stream, the conveyance speed of the strip or profile material, the strength of the direct current voltage applied and/or the composition of the electrolyte makes it possible to deposit pre-determinable, differing thicknesses of the coagulated films on the two surfaces.

The strip or profile material can be positioned flat and conveyed horizontally and electrolytic liquid can be applied from below and/or from above.

If the strip, flat and moving horizontally, is coated only from above or below in an initial step and using the first electrolyte, the strip can be rotated through 180° following the first coating step in order to undertake the second coating step in the same direction. Furthermore the strip or profile material can be coated while positioned upright, i.e. on edge, on both sides, simultaneously or sequentially. Here the strip or profile material can be conveyed along either a horizontal or vertical axis.

Using the process which is the subject of the invention makes it possible to coat strip or profile material in a continuous process in a pre-determinable fashion at differing layer thicknesses and/or with differing paints, which offers considerable advantages since it is often precisely this capability which is required for certain applications.

BRIEF DESCRIPTION OF THE DRAWINGS

FIG. 1 is a schematic representation figuratively depicting the various stations in the coating system.

DESCRIPTION OF PREFERRED EMBODIMENTS

The invention is explained in further detail below on the basis of a sample embodiment illustrated schematically in the drawing.

The example shown here refers to the coating of strip material 5, but can be utilized in an analog fashion for profile material. Whereas strip material 5 is unrolled from a coil mounted on a feed reel 1 and directed through the system and again accumulated on a take-up reel 21, profiled material can be passed straight through the system whereby this profiled material can be introduced into and removed from the system as rod-like material or can be unrolled as strip material from a coil located on a feed reel 1, passed through a profiling system not illustrated here and then passed through the system as a profile. When electrocoating profiled material the take-up reel 21 at the end of the system is eliminated and replaced by a system, not illustrated here, for cutting profiles to length.

With reference to the coating of strip material 5, the system is configured as follows: The strip material 5 unrolled from the feed reel 1 is passed through a first pair of conveyor rollers 2, a cleaning unit 3, a further pair of conveyor rollers 2, and a rinsing unit 4 until the horizontal strip material 5 reaches a further pair of rollers 6 which is located immediately in front of a coating system. This pair of rollers 6 is connected by means of a conductor 14 with the positive pole of a source of direct current and thus applies to the strip material the positive pole of the direct current source 13 so that the strip material 5 becomes the anode. The positive pole of the direct current supply 13 is grounded, eliminating any need to insulate the entire system. The coating system comprises a drip pan 7 located beneath the strip material 5 to catch electrolytic liquid 8 and a cover hood 7*a* positioned above the strip material 5. A pump 9 draws electrolytic liquid out of the drip pan 7 and moves it through a pipe 10 to a nozzle 11 located above the strip material 5 and/or to a nozzle 12 located below the strip material. The nozzles 11, 12 cover the entire width of the strip material 5 and apply electrolyte to the surfaces of the strip material 5 in a uniform, continuous stream or curtain of liquid, through which electrical connection is maintained with the nozzles 11, 12 and thus via a conductor cable 15 with the negative pole of the direct current supply 13. The nozzles 11, 12 are electrically insulated from the drip pan 7, the cover hood 7*a* and the pump 9. As the strip material 5 passes between the nozzles 11, 12 potential is equalized between the strip material 5 functioning as the anode and the nozzles 11, 12 acting as the cathode, this taking place through the stream of electrolytic liquid. The paint particles thus coagulate on the strip material in its function as the anode, forming a film, whereby the layer thickness can be determined by adjusting the conveyance speed of the strip material, the cross section of the stream, the velocity of the stream, the DC voltage generated by the direct current source 13 and/or the composition of the electrolyte so that a pre-determinable layer thickness, varying from one surface to the other if desired, can be achieved.

A pair of squeegee rolls 16 is located inside the space defined by the drip pan 7 and the cover hood 7*a*; they strip off the non-coagulated electrolytic liquid which is carried along on the strip.

The the strip material 5 is moved by means of conveyor rollers 17 to a rinsing unit 18 and a dryer 19 from which point the strip material 5 is drawn off by a further pair of conveyor rollers 20 and wound up on a take-up reel 21 to again form a coil.

If, as previously mentioned, differing electrolytic liquids are used it is possible in a fashion not illustrated to arrange two drip pans 7 with cover hood 7*a*, the nozzles 11, 12 located therein, squeegee rollers 16 and a pump 9 one after another in sequence so that, for example, in the first coating step the upper surface of the strip material 5 can be coated with an electrolytic liquid, of a certain color or of a certain composition for instance, to a pre-determinable layer thickness and then subsequently, in the following coating unit, to coat the other side of the strip material 5 in the desired fashion. This makes it possible to achieve differing colors on the top and bottom faces of the strip material and/or to achieve differing coating thicknesses.

The strip material 5 can be passed flat and horizontally through the coating system as illustrated. It is just as possible to move the strip material 5 horizontally but with the material upright, on edge, by means of which it may be possible to reduce the width of the system. It is also possible to rotate the strip material 5 through 180° after coating one side and then to coat the other side in such cases where the position of the nozzles 11, 12 is always to be such that the stream is directed toward the strip material 9 from the top downward or from the bottom upward.

Finally it is also possible to convey the strip material vertically or sloped at an upward or downward angle and to direct it thusly through the coating system.

The great flexibility described above which is inherent to the innovative process is one of the major advantages which derives from the innovative process.

Finally it is to be mentioned that it is also possible to position several rows of nozzles one after the other along the conveyance axis for the strip material 5 as this will make it possible to increase the throughput volume of the electrolytic liquid and possibly thus the throughput speed for the strip material 5.

In all cases it is important that the stream or curtain of liquid exiting the nozzles 11, 12 form a continuous layer covering the entire width of at least one of the surfaces of the strip or profile material in order to coat by means of film formation the entire surface of the strip or profile material wetted by the electrolytic liquid.

I claim:

1. A process for anodic or cathodic electrocoating of strip or profile material, said material having a first and second surface and a width, said process comprising the steps of:

a) conveying the strip or profile material through a first coating process for continuous application of a first electrolytic liquid to the first surface, said first electrolytic liquid having a first composition, said first coating process comprising the steps of:

i) using said first electrolytic liquid to make an electrically conductive first connection between a first spray nozzle and the first surface of the strip or profile material, said first spray nozzle being directed toward the first surface forming a first continuous stream or curtain of liquid made up of a first water-soluble paint thereby creating a first continuous layer of said first electrolytic liquid on the first surface;

ii) forming a first film on the first surface by applying a first direct current voltage between said first spray nozzle and the first surface of the strip or profile material; and b) conveying the strip or profile material through a second coating process for continuous application of a second electrolytic liquid to the second surface, said second electrolytic liquid having a second composition differing from said first composition of said first electrolytic liquid, said second coating process comprising the steps of:

i) using said second electrolytic liquid to make an electrically conductive second connection between a second spray nozzle and the second surface of the strip or profile material, said second spray nozzle being directed toward the second surface forming a second continuous stream or curtain of liquid made up of a second water-soluble paint thereby creating a second continuous layer of said second electrolytic liquid on the second surface;

ii) forming a second film on the second surface by applying a second direct current voltage between said second spray nozzle and the second surface of the strip or profile material.

2. The process according to claim 1, wherein said first continuous layer has a layer thickness, further comprising the step of varying said layer thickness by varying the composition of the first electrolytic liquid.

3. The process according to claim 1, wherein said first stream has a cross-section and said first continuous layer has a layer thickness, further comprising the step of varying said layer thickness by varying said cross-section of said first stream.

4. The process according to claim 1, wherein said first stream has a velocity and said first continuous layer has a layer thickness, further comprising the step of varying said layer thickness by varying the velocity of said first stream.

5. The process according to claim 1, wherein the strip or profile material is conveyed at a throughput velocity and said first continuous layer has a layer thickness, further comprising the step of varying said layer thickness by varying the throughput velocity of the strip or profile material.

6. The process according to claim 1, wherein said first film has a thickness, further comprising the step of controlling said thickness by varying said first direct current voltage.

7. The process according to claim 1, wherein said first coating process and said second coating process are carried out simultaneously, and at the same location, on opposing surfaces of the strip or profile material.

8. The process according to claim 1, wherein said first coating proces and said second coating process are carried out at differing locations of the strip or profile material.

9. The process according to claim 1, wherein the first electrolytic liquid and the second electrolytic liquid are of differing colors.

10. The process according to claim 1, wherein the strip or profile material is laid flat and conveyed horizontally and to which the first and second electrolytic liquids are applied.

11. The process according to claim 1, wherein, the strip is turned through 180 degrees after the first surface is coated.

12. The process according to claim 1, wherein the strip or profile material stands uprights, on edge, is conveyed horizontally or vertically and is coated with the first electrolytic liquid on the first surface and the second electrolytic liquid on the second surface.

13. A process for anodic or cathodic electrocoating of strip or profile material, said material having a first and second surface and a width, said process comprising the steps of:

a) conveying the strip or profile material through a first coating process for continuous application of a first electrolytic liquid to the first surface, said first coating process comprising the steps of:

i) using said first electrolytic liquid to make an electrically conductive first connection between a first spray nozzle and the first surface of the strip or profile material, said first spray nozzle being directed toward the first surface forming a first continuous stream or curtain of liquid made up of a first water-soluble paint thereby creating a first continuous layer of said first electrolytic liquid on the first surface;

ii) forming a first film on the first surface by applying a first direct current voltage between said first spray nozzle and the first surface of the strip or profile material; and b) conveying the strip or profile material through a second coating process for continuous application of a second electrolytic liquid to the second surface, said second coating process being downstream of said first coating process in the direction of conveying the strip or profile material, said second coating process comprising the steps of:

i) using said second electrolytic liquid to make an electrically conductive second connection between a second spray nozzle and the second surface of the strip or profile material, said second spray nozzle being directed toward the second surface forming a second continuous stream or curtain of liquid made up of a second water-soluble paint thereby creating a second continuous layer of said second electrolytic liquid on the second surface;

ii) forming a second film on the second surface by applying a second direct current voltage between said second spray nozzle and the second surface of the strip or profile material.

14. The process according to claim 13, wherein said first electrolytic liquid and said second electrolitic liquid are of different composition.

15. The process according to claim 13, wherein said first electrolytic liquid and said second electrolytic liquid are of the same composition.

16. The process according to claim 13, wherein at least one of said first and second continuous layers have a layer thickness, further comprising the step of varying said layer thickness by varying the composition of said first or said second electrolytic liquid.

17. The process according to claim 13, wherein at least one of said first and said second streams have a cross-section and at least one of said first and said second continuous layers have a layer thickness, further comprising the step of varying said layer thickness by varying said cross-section.

18. The process according to claim 13, wherein at least one of said first and second stream have a velocity and at least one of said first and second continuous layers have a layer thickness, further comprising the step of varying said layer thickness by varying said velocity.

19. The process according to claim 13, wherein the strip or profile material is conveyed at a throughput velocity and at least one of said first or second continuous layers have a layer thickness, further comprising the step of varying said layer thickness by varying said throughput velocity of the strip or profile material.

20. The process according to claim 13, wherein at least one of said first or second films have a thickness, further comprising the step of controlling said thickness by varying at least one of said first and second direct current voltages.

* * * * *